US010092094B2

(12) United States Patent
Sagel

(10) Patent No.: US 10,092,094 B2
(45) Date of Patent: Oct. 9, 2018

(54) FITTING FOR A CORNER CUPBOARD AND CORNER CUPBOARD WITH FITTING

(71) Applicant: Vauth-Sagel Holding GmbH & Co. KG, Brakel (DE)

(72) Inventor: Claus Sagel, Bielefeld (DE)

(73) Assignee: VAUTH-SAGEL HOLDING GMBH & CO. KG, Brakel (DE)

( * ) Notice: Subject to any disclaimer, the term of this patent is extended or adjusted under 35 U.S.C. 154(b) by 0 days.

(21) Appl. No.: 15/793,019

(22) Filed: Oct. 25, 2017

(65) Prior Publication Data

US 2018/0049545 A1 Feb. 22, 2018

Related U.S. Application Data

(63) Continuation of application No. PCT/EP2016/058717, filed on Apr. 20, 2016.

(30) Foreign Application Priority Data

Apr. 30, 2015 (EP) ..... 15 166 079

(51) Int. Cl.
*A47B 49/00* (2006.01)

(52) U.S. Cl.
CPC ..... *A47B 49/006* (2013.01)

(58) Field of Classification Search
CPC ..... A47B 49/006
See application file for complete search history.

(56) References Cited

U.S. PATENT DOCUMENTS 4,639,051 A * 1/1987 DeBruyn ..... A47B 96/16 312/275
4,738,495 A * 4/1988 Mitts ..... A47B 49/006 108/140
4,832,300 A * 5/1989 Twellmann ..... A47B 49/006 248/240.1

(Continued)

FOREIGN PATENT DOCUMENTS

DE 77 11 111 U 7/1977
DE 37 30 832 A1 3/1988

(Continued)

OTHER PUBLICATIONS

International Preliminary Report on Patentability and Written Opinion dated Jul. 13, 2016.

*Primary Examiner* — Hanh V Tran
(74) *Attorney, Agent, or Firm* — Thomas | Horstemeyer, LLP

(57) ABSTRACT

A fitting for a corner cupboard comprises a support arm mounted to a basis such that it can be pivoted in a pivoting movement about a first vertical pivot axis; an elongated tray supported on the support arm such that it can be pulled out in a pull-out movement along a horizontal axis. A coupling device coupling the pivoting movement of the support arm to the pull-out movement of the tray comprises a control arm which, at its one end, is mounted to the basis such that it can be pivoted about a second vertical pivot axis and which, at its other end, is mounted to the tray such that it can be pivoted about a third vertical pivot axis. In a pushed-in position of the tray the second pivot axis, when viewing along the horizontal axis, is arranged between the first and third pivot axes.

19 Claims, 15 Drawing Sheets

(56) References Cited

U.S. PATENT DOCUMENTS

| | | | | |
|---|---|---|---|---|
| 7,318,631 | B2 * | 1/2008 | Kreyenkamp | A47B 81/002 312/238 |
| 8,911,035 | B2 * | 12/2014 | Kopnick | A47B 81/002 312/238 |
| 9,101,215 | B2 * | 8/2015 | Kreyenkamp | A47B 81/002 |
| 9,119,470 | B2 * | 9/2015 | Kreyenkamp | A47B 81/002 |
| 2010/0084952 | A1 * | 4/2010 | Sagel | A47B 46/00 312/238 |
| 2011/0193455 | A1 * | 8/2011 | Kreyenkamp | A47B 81/002 312/238 |
| 2014/0147200 | A1 * | 5/2014 | Baro | A47B 49/006 403/382 |

FOREIGN PATENT DOCUMENTS

| | | | | |
|---|---|---|---|---|
| DE | 102006035157 | A1 * | 4/2007 | A47B 81/002 |
| EP | 1 616 503 | A2 | 6/2005 | |
| EP | 1776899 | A1 * | 4/2007 | A47B 46/00 |
| EP | 2 064 971 | A1 | 11/2007 | |
| EP | 2 092 850 | A1 | 2/2008 | |
| EP | 2 092 850 | B1 | 2/2008 | |
| EP | 2 253 244 | B1 | 1/2014 | |

* cited by examiner

FITTING FOR A CORNER CUPBOARD AND CORNER CUPBOARD WITH FITTING

CROSS REFERENCE TO RELATED APPLICATIONS

This application is a continuation of International Application PCT/EP2016/058717 with an International Filing Date of Apr. 20, 2016 and claiming priority to European Patent Application No. EP 15 166 079.2, now European Patent EP 3 087 866 B1, entitled "Fitting for a Corner Cupboard and Corner Cupboard with Fitting", filed on Apr. 30, 2015.

FIELD

The invention relates to a fitting for a corner cupboard. Furthermore, the invention relates to a corner cupboard comprising such a fitting.

BACKGROUND

German registered utility model DE 77 11 111 U discloses a pivoting device for intermediate shelves or racks of corner cupboards. The pivoting device consist of a support frame to be mounted to a central column of the corner cupboard. In a horizontal plane the support frame is pivotable by 90°. The intermediate shelf or rack is mounted to the support frame in such a way that it is slidable in a longitudinal direction.

German patent application publication DE 37 30 832 A1, corresponding to U.S. Pat. No. 4,832,300, discloses a revolving shelf for a corner cupboard equipped with a pull-out device. A truss is to be fixed to a corpus of the corner cupboard so that it is pivotable about a vertical pivot axis. To the truss, drawer rails for supporting the revolving shelf are fixed. By a coupling mechanism, the pivot movement of the truss with respect to the corpus is coupled with the linear pull-out movement of the revolving shelf with respect to the truss in such a way that the revolving shelf in the pulled-out position does not strike against the corpus. The coupling mechanism is formed by a curved track guiding with one guiding organ to be fixed to the corpus and another guiding organ engaging the one guiding organ and fixed to the revolving shelf. The other guiding organ fixed to the revolving shelf is a guiding groove realised on the underside of the revolving shelf, and the guiding organ fixed to the corpus is a guiding pin. The guiding groove has a curved portion which, at least at one of its ends, continuously merges into a straight portion parallel to the drawer rails. In this way, though the pivoting movement of the truss and the linear pull-out movement of the revolving shelf flow into one another, they are, apart from the merge region, separated in such a way that the revolving shelf is either pivoted around the vertical pivot axis with the truss or is linearly pulled out from the truss.

European patent EP 2 253 244 B1 discloses a pivoting and pulling-out fitting for a lower shelf in a corner cupboard which comprises a truss held in the corner cupboard pivotable around a vertical pivot axis, an intermediate truss pivotable with respect to the truss around a further pivot axis parallel to the pivot axis of the truss but offset to it, and drawer rails on which the lower shelf is linearly slidable with respect to the intermediate truss. During the entire movement, the pivot movement of the intermediate truss with respect to the truss is controlled by a forced guide element fixed to the corpus. The forced guide element is a slotted guiding piece arranged on a console supporting the second pivot axis of the truss A cam follower placed on the intermediate truss engages this slotted guiding piece. The forced guide element is designed in such a way that in a starting phase of a pivot movement by which the lower shelf is pivoted out of the corner cupboard it hinders a rotation of the intermediate truss with regard to the truss. Additionally, the lower shelf is guided directly on the truss via a guiding device designed in such a way that, in the starting phase of the pivoting movement, it blocks a sliding movement of the lower shelf with regard to the intermediate truss and the truss. Furthermore, the guiding device is designed in such a way that, in an end phase of a movement of the lower shelf, after it has been pivoted out of the corner cupboard, it only allows for a sliding movement of the lower shelf with regard to the intermediate truss and blocks a rotation of the intermediate truss with regard to the truss. Therefore, here, too, the pivoting movement and the pulling-out movement of the lower truss are only overlaid in a central merge region again.

European patent application publication EP 1 616 503 A2, corresponding to U.S. Pat. No. 7,318,631 B2, discloses a corner cupboard comprising an interior which is cuboid in outline and accessible from the front by about half via a cupboard door. In the corner cupboard, at least one one-part tray of approximately semi-circular shape is supported. By means of a fitting, the tray is movable from an inner position into an outer position in which the tray towards the front juts out over the plane of the opening of the door of the corner cupboard. The fitting comprises an at least nearly vertical support column and two control levers attached with a joint on the underside of the tray. The first control lever is pivotable around the support column mounted in the interior next to the door opening and the second control lever is pivotable around an axis of a support bearing which is parallel to the support column. The support bearing is arranged close to the door opening on the side wall of the corner cupboard limiting the door opening. The tray makes a movement controlled by both control levers when transferring from the inner position into the outer position and the other way around. In its outer position, the tray does not only lie in front of the door opening but it also extends to the side from the door and to the side of the corner cupboard juts out over the door opening. Therefore, there has to be space for pulling the tray out into its outer position.

European patent application publication EP 2 092 850 A1, corresponding to EP 2 092 850 B1, discloses a fitting for a corner cupboard for a movable guiding of at least one tray between an inner position in an interior of the corner cupboard and an outer position in which the tray at least partially juts out over a plane of an opening of the door of the corner cupboard. The fitting comprises a support arm for supporting the tray on the one hand mounted pivotably around a pivot axis that is spatially fixed at least in a mounted position and on the other hand mounted pivotably in a support location on the corresponding tray and at least one control device for controlling the tray movement between the inner and the outer position. The control device comprises a first single control lever and a second single control lever which each are supported pivotably on the one hand around a spatially fixed joint axis and on the other hand around a pivot axis fixed with respect to the tray. Both pivot axes fixed with respect to the tray are arranged on the same side of the tray with respect to the support location of the support arm. In the support location, the tray is not only supported pivotably with respect to the support arm but by means of a guiding device is also linearly movable. In other words, the pivot bearing of the tray is slidable along the support arm. As an alternative, the support arm comprises two support arm parts connected with each other in a jointed way via a connecting joint in order to realise a variable effective length of the support arm between its spatially fixed pivot axis and the pivot axis between it and the tray.

European patent application publication EP 2 064 971 A1 discloses a fitting for a corner cupboard, which movably guides at least one tray between an inner position in an interior of the corner cupboard and an outer position in which the tray at least partially juts out over a plane of an opening of the door of the corner cupboard. The fitting comprises a support arm for supporting the tray on the one hand supported pivotably around a pivot axis that is spatially fixed in its mounted state and on the other hand pivotably supported in a support location on the corresponding tray and a control device for controlling the tray movement between the inner and the outer position. The control device comprises a first multi-joint lever rodding and a second multi-joint lever rodding which each are supported pivotably on the one hand around a joint axis that is spatially fixed in the mounted state of the tray and on the other hand around a pivot axis fixed with respect to the tray. The two pivot axes are arranged with a distance towards one another, where the pivot axis of the first multi-joint lever rodding is arranged in the region of the support location. In the region of the support location, in which the support arm is supported on the corresponding tray, the tray rests rotatably on a guiding sleeve which is guided to be linearly movable on the support arm.

There still is a need of a fitting for a corner cupboard within which a pivoting movement and a pulling-out movement of a tray are overlaid with each other to form a harmonic overall movement which brings the tray out of the interior of the corner cupboard and in front of its door opening with a substantial part of its area.

SUMMARY OF THE INVENTION

The present invention relates to a fitting for a corner cupboard. The fitting comprises a basis having fixation devices configured for fixation of the basis in a stationary way, and a support arm mounted to the basis in such a way that it, with regard to the basis, can be pivoted in a pivoting movement about a first vertical pivot axis out of a swung-in position into a swung-out position. The fitting further comprises a tray which is elongated along a horizontal axis and supported on the support arm by means of at least two drawer rails, and which, with regard to the support arm, can be pulled out in a pull-out movement in a direction along the horizontal axis out of a pushed-in position into a pulled-out position, wherein stationary parts of the at least two drawer rails are fixed to the support arm, and wherein movable parts of the drawer rails are fixed to the lower face of the tray. The fitting further comprises a coupling device coupling the pivoting movement of the support arm with regard to the basis to the pull-out movement of the tray with regard to the support arm. The coupling device comprises a control arm which, at its one end, is mounted to the basis in such a way that it, with regard to the basis, can be pivoted about a second vertical pivot axis and which, at its other end, is mounted to the tray in such a way that it, with regard to the tray, can be pivoted about a third vertical pivot axis. The third pivot axis, with regard to the pull-out movement, runs in a back area of the tray, and the second pivot axis, in the pushed-in position of the tray, when viewing along the horizontal axis, is arranged between the first pivot axis and the third pivot axis.

Further, the present invention relates to a corner cupboard comprising a corpus, a cuboid-shaped interior defined by the corpus, a door opening only extending over a part of a width of the interior, and a fitting according to the present invention, the basis of the fitting being fixed to the corpus in a stationary way by means its fixation devices.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DESCRIPTION OF THE INVENTION

Figure 1:
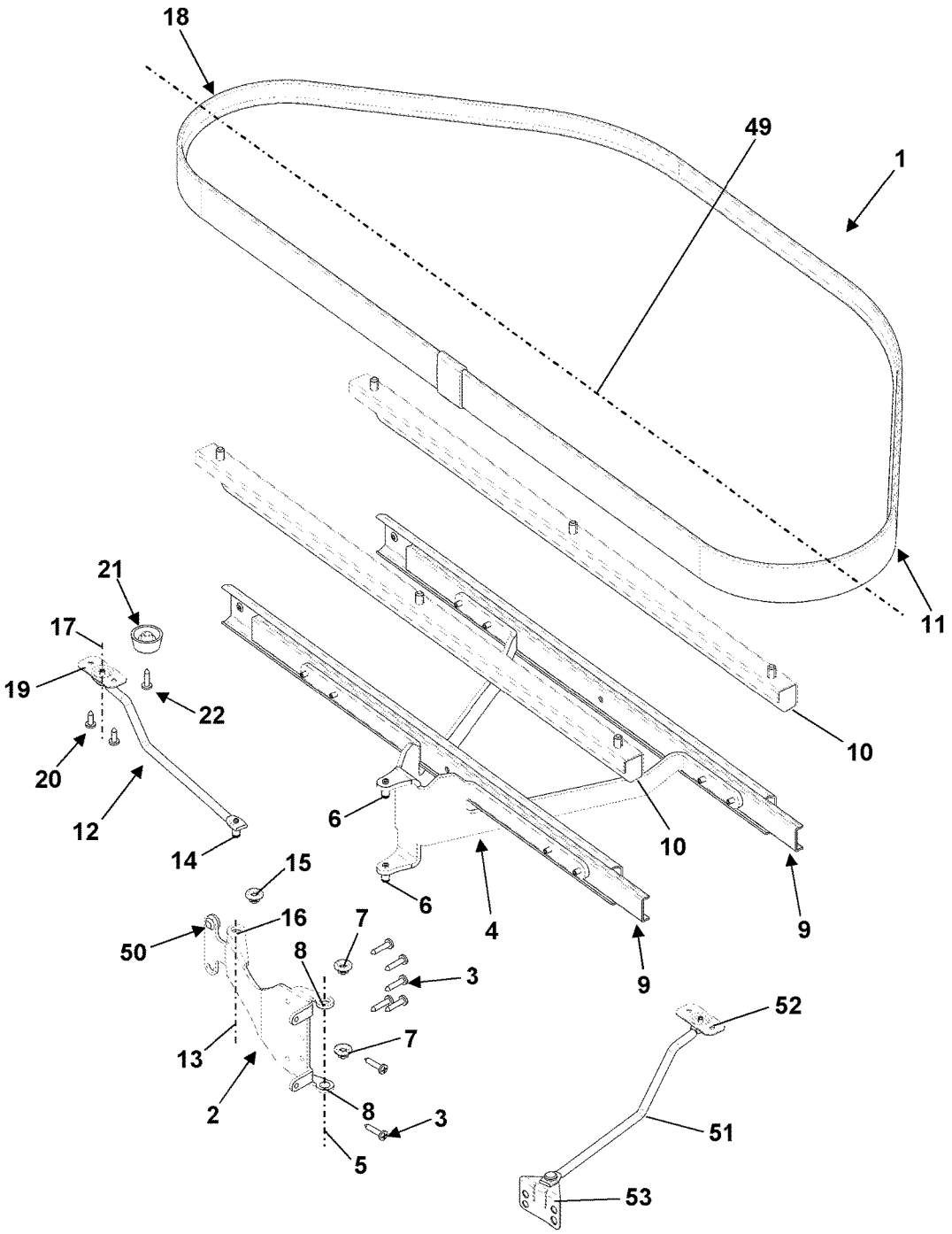
FIG. 1 is an exploded view drawn in perspective of a first embodiment of a fitting for a corner cupboard.

The term corner cupboard refers to a cupboard whose corpus defines a cuboid interior which is accessible via a door opening only extending over about approximately half of the width of the interior. Therefore, trays supported in the corpus can only easily be loaded and unloaded if they can be moved out of the interior through the door opening to at least a substantial extent. The invention relates to a fitting which enables such a movement of one or more trays—having an area as large as possible—through the door opening.

In one embodiment of a fitting for a corner cupboard comprising a basis having a fixation device for fixation in a stationary way, a support arm mounted on the basis to be pivotable around a first vertical pivot axis from a swung-in position into a swung-out position in a pivoting movement, a tray elongated along a horizontal axis and supported on the support arm in a way that allows it to be pulled out from a pushed-in position into a pulled-out position in a pull-put movement along the axis and a coupling device coupling the pivoting movement of the support arm with the pull-out movement of the tray, the coupling device comprises a control arm which on its one end is mounted to the basis pivotably around a second pivot axis and on its other end is mounted to the tray pivotably around a third pivot axis. The third pivot axis runs in a back area of the tray with respect to the pull-out movement, and the second pivot axis in the pulled-in position of the tray lies between the first pivot axis and the third pivot axis when viewed along the horizontal axis.

In one embodiment of the fitting for a corner cupboard, a distance between the first pivot axis and the second pivot axis in the pulled-in position of the tray, when viewed along the horizontal axis, is in a range from 10 to 90%, or from 20 to 80%, or from 30 to 70% or from 40 to 60% of a distance between the first pivot axis and the third pivot axis. Correspondingly, a distance between the second pivot axis and the third pivot axis then is in a range from 90 to 10%, or from 80 to 20%, or from 70 to 30%, or from 60 to 40% of the distance between the first pivot axis and the third pivot axis.

In the fitting, the tray is in a proven and reliable way supported via the support arm, with respect to which the tray is linearly displaceable and which with respect to the spatially fixed basis of the fitting is pivotable. The control arm of the coupling device serves exclusively for coupling the pivoting movement of the support arm and the pull-out movement of the tray. The second pivot axis, around which the control arm is pivotable with respect to the basis, lies further back than the first vertical pivot axis around which the support arm is pivotable with respect to the basis when viewed in the direction of the horizontal axis along which the tray is extendable with respect to the support arm in the pushed-in position of the tray. The third vertical pivot axis, around which the control arm is pivotably supported on the tray, in this view lies even farther back. The back area of the tray, in which the third pivot axis runs, can even lie outside a storage area of the tray. Then, the control arm is supported pivotably around the third pivot axis on a fixed cantilever arm of the tray which juts out to the back from the storage area of the tray. The control arm causes a complete overlay of the pull-out movement of the tray and the pivoting movement of the support arm, where the relative shares starting from the pushed-in position of the tray continuously shift from the pivot movement to the pull-out movement. In the opposite direction of movement of the tray into its pushed-in position it is the other way around.

In the fitting, the control arm, in each pivot position around the second pivot axis, has a positively defined length between the second pivot axis and the third pivot axis with respect to the basis. This positively defined length can be constant over all pivot positions around the second pivot axis with respect to the basis. Then, the coupling device of the fitting is constructed in an especially simple way.

In one embodiment, the control arm comprises a plurality of partial arms pivotable with respect to one another around further vertical pivot axes and a length varying over its pivot positions around the second pivot axis with respect to the basis realised in this way. With the aid of the variable, but for each pivot position around the second pivot axis still positively defined length of the control arm, the coupling device of the fitting may even guide a tray of maximum dimensions, that is, a maximum area, securely through the door opening of the respective corner cupboard without striking against the corpus of the corner cupboard. In other words, by the aid of a variable length of the control arm, the area of the tray can be increased at constant dimensions of the corner cupboard with respect to a control arm of constant length.

In order to set the length of the control arm dependently on its pivot position around the second pivot axis, a control pin extending vertically from a partial arm of the control arm can engage with a horizontally running horizontal cam track stationary with respect to the basis with the tray. Preferably, the cam track in the basis runs around the second pivot axis. In order to reduce friction between the control pin and the cam track, on the control pin a guiding roller can be supported via which the control pin engages with the edge of the cam track.

Practically, the control arm may have three partial arms, where two of the three partial arms are connected with each other via a horizontal elongated hole in one of the two partial arms in a pivoting way, while the other vertical pivot axes between the partial arms are fixed along the partial arms. The partial arms can all be straight. Especially the partial arm with the elongated hole can also be curved, however, and the elongated hole extending along this partial arm can have a correspondingly curved shape.

In another practical embodiment, the control arm has four partial arms in a four-joint arrangement. Two of the four partial arms can be arranged in a parallelogram control lever arrangement, where at least one, frequently two of the partial arms can protrude outwards over the four pivot axes formed between the four partial arms.

In the fitting, a tension spring may be attached to the basis and the control arm in such a way that it loads the tray into its pushed-in position when it approaches this pushed-in position and into its pulled-out position when it approaches this pulled-out position. The tension spring in this way does not only provide self-closing for the tray, but also brings the tray completely into its pulled-out position and keeps it in this pulled-out position until it is consciously pushed back. Practically, the tension spring in the pushed-in position of the tray can run on the side of the pivot axis turned away from the tray and in the pulled-out position of the tray run on the side of the second pivot axis turned towards the tray. This means that during the pulling-out of the tray the tension spring moves over the second pivot axis and at the same time reaches its point of maximum extension.

The basis of the fitting may include a vertical support column which comprises the fixation devices on its upper and lower end. This support column can be fixed in the interior of the respective corner cupboard next to the door opening.

Furthermore, the basis may comprise a base on which the support arm is mounted pivotably and which generally is supported on the support column fixedly, but in a height-adjustable way. Several bases for several trays can be mounted on the support column one above the other.

In the pushed-in position of the tray, when viewed along the horizontal axis, the support column can lie between the first and the second pivot axis. In this way, the first pivot axis around which the support arm is pivotable, when viewed from the support column, is arranged in the direction of pulling out, while the second pivot axis is arranged further back in the interior of the cupboard.

Furthermore, the support column in the pushed-in position of the tray may be on one side of a vertical plane defined by the first pivot axis and the second pivot axis while drawer rails arranged between this support arm and the tray lie on the other side of this vertical plane. The tray itself in its pushed-in position can jut out over the plane defined by the first and the second pivot axis, so that the support arm and the control arm are arranged below the tray on the basis.

A corner cupboard according to the invention comprising a corpus, a cuboid-shaped interior defined by the corpus and a door opening extending over only a part of a width of the interior comprises a fitting according to the invention fixed to the corpus with its basis.

The basis preferably is not fixed to the corpus in a region of the interior lying behind the door opening but in a region of the interior lying next to the door opening. The first vertical pivot axis pivotably around which the support arm is mounted to the basis, on the contrary, preferably runs through the region of the interior of the corner cupboard lying behind the door opening.

Typically, the corner cupboard will comprise a cupboard door that can be pivotably opened around a vertical door pivot axis lying in the region of the front cupboard centre. To the cupboard door and the tray—with the lowest tray, if there are several trays—a coupling element that is at least stiff with regard to tension can be linked. Through this coupling element, the tray can be moved out of the interior of the corner cupboard at the pivoting open of the cupboard door, while by the coupling element the cupboard door is pivoted closed again when the tray is moved inside the interior. The multiple joint arrangement formed by the door, the coupling element and the tray mounted via the support arm of the basis is not completely defined even when the coupling element is not only stiff with regard to tension but also stiff with regard to pressure. The coupling element therefore does not replace the control arm of the fitting. If several trays are provided, as has been hinted at, only the lowest may be moved out of the interior with the cupboard door. Then items placed on it are approachable. When needed, a further tray arranged above it can be separately moved out of the interior of the corner cupboard and back into the interior of the corner cupboard.

Now referring in greater detail to the drawings, the fitting 1 shown in FIG. 1 comprises a basis 2 for fixedly mounting the fitting 1 with the aid of fixing screws 3. On the basis 2, a support arm 4 is mounted pivotably around a first vertical pivot axis 5. Bearing pins 6 of the support arm 4 engage with bearing sockets 7 which have been inserted into bearing eyes 8 of the basis 2. On the support arm 4, the spatially fixed parts of two drawer rails 9 arranged parallel to one another are fixed. On the movable parts of the drawer rails 8, longitudinal struts 10 are fixed, which are mounted to the underside of a tray 11. The tray 11 along a horizontal axis 49 is elongated and in the direction of this horizontal axis 49 can be extended with respect to the support arm 4 by means of the drawer rails 9, while the support arm 4 is pivotable with respect to the basis 2 around the vertical pivot axis 5. The pull-out movement of the tray 11 and the pivot movement of the support arm 4 are coupled by a control arm 12. The control arm 12 is supported on the basis 2 pivotably around a second vertical pivot axis 13, where a bearing pin 14 of the control arm 12 engages with a pivot bearing socket 15 which has been inserted into a bearing eye 16 of the basis 2. On its other end, the control arm 12 is supported pivotably around a third vertical pivot axis 17 in a back area 18 of the tray 11 along the axis 49 in the pull-out direction. In order to achieve this, a support plate 19 has been screwed onto the tray 11 from below via fixing screws 20. Additionally, a stopper buffer 21 is mounted to the underside of the tray 11 with a screw 22, with which the tray in its maximum extended position impacts onto the support arm 4 to dampen its final contact. A further stopper buffer 50 is provided on the basis 2. Onto it, the control arm 12 impacts when the tray 11 reaches its maximally pushed-in position. A coupling element 51 is supported on the underside of the tray 11 and on a console 53 via a support plate 52 and pivotably around a further vertical pivot axis.

Figure 2:
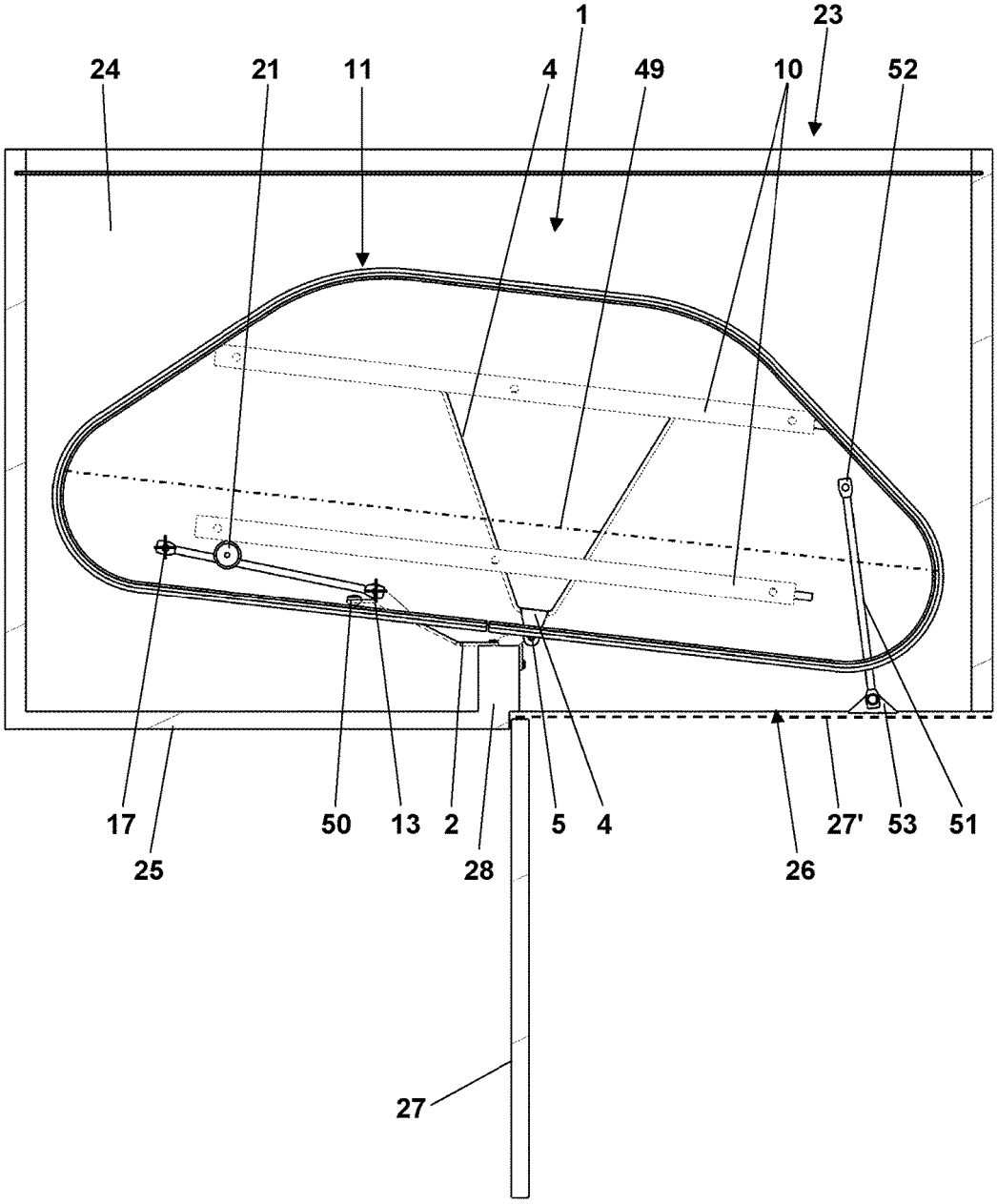
FIG. 2 (*a*) to (*d*) shows the movement of the tray of the fitting according to FIG. 1 out of a corner cupboard in which the fitting is mounted.
Figure 2:
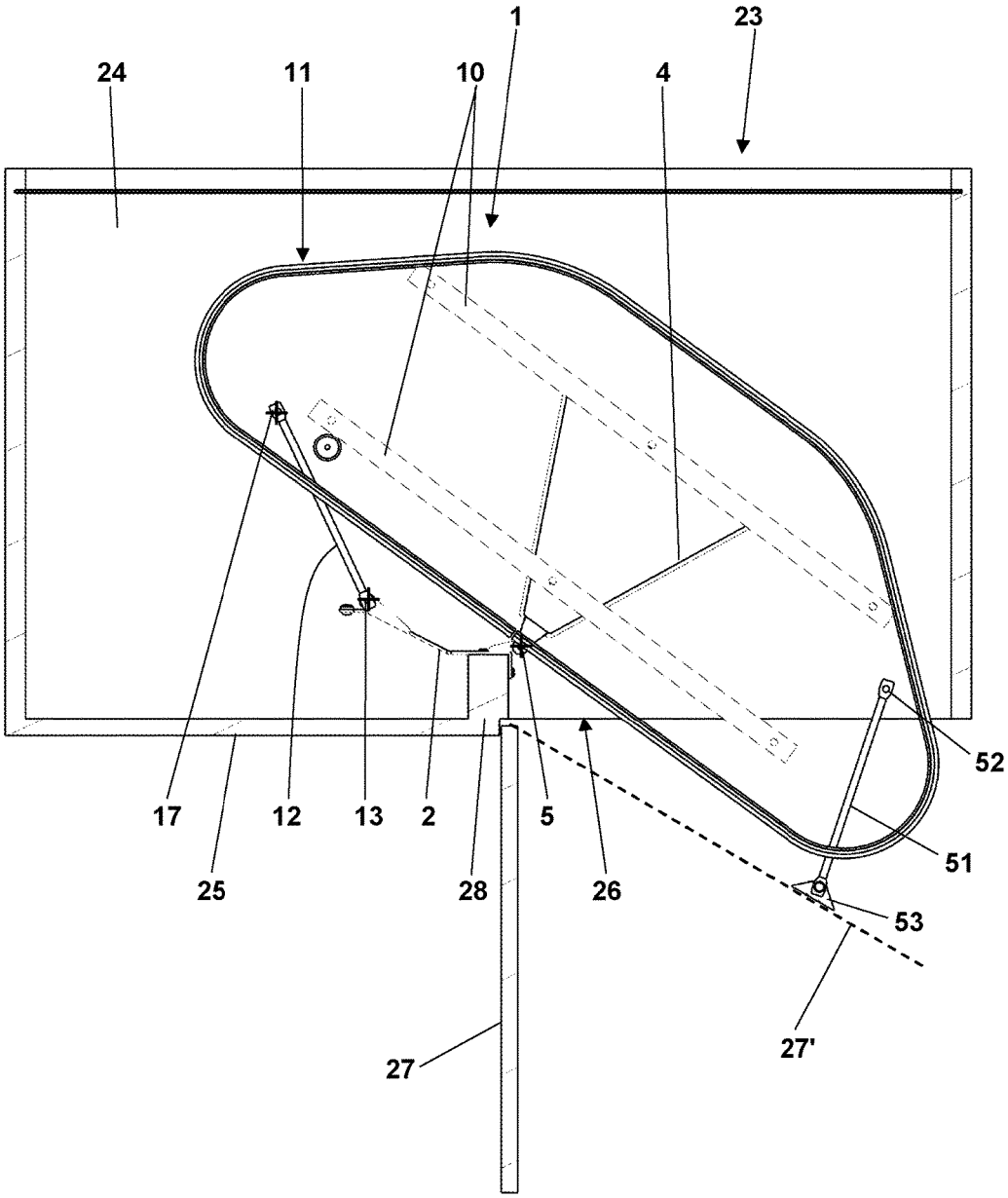
Figure 2:
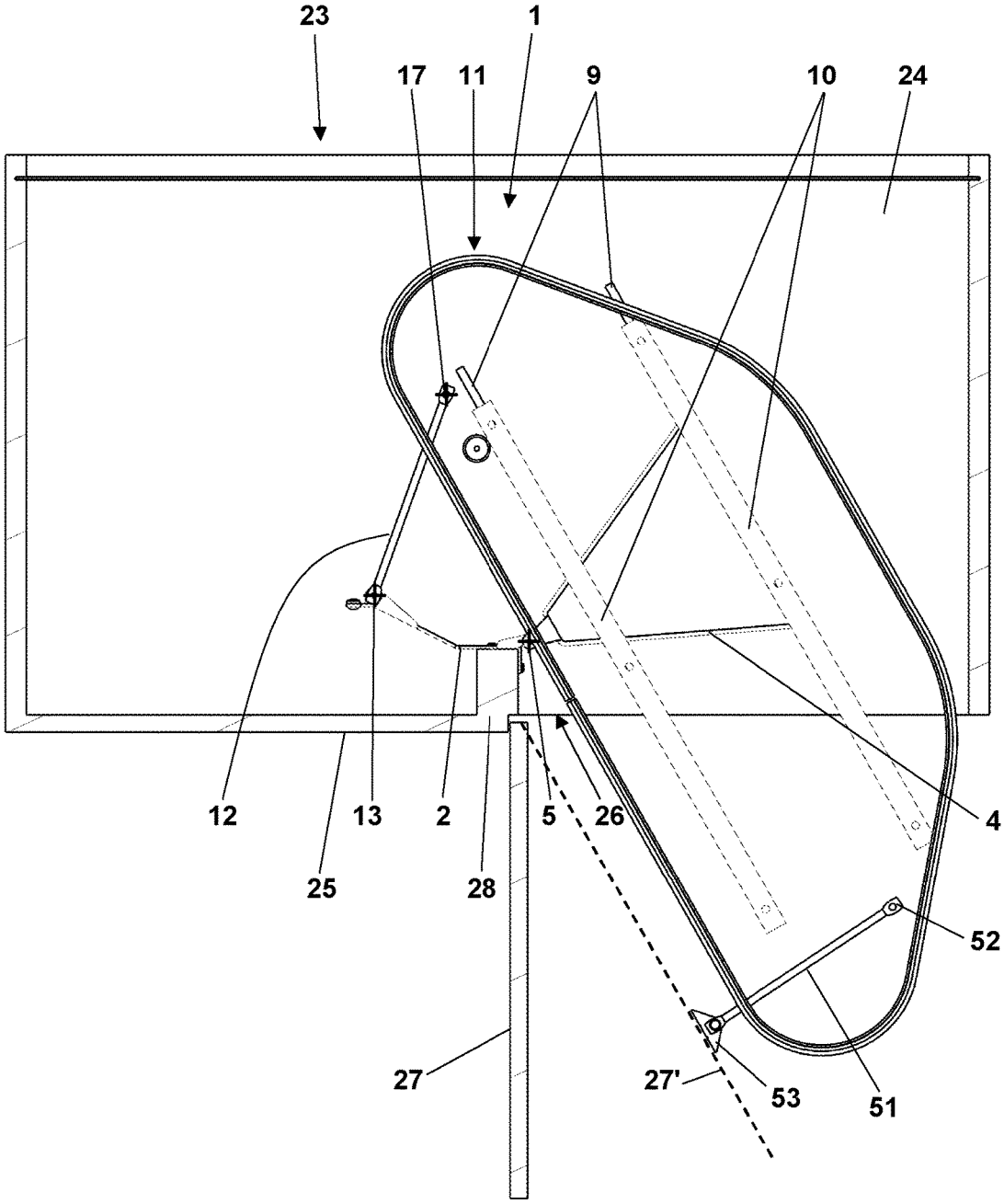
Figure 2:
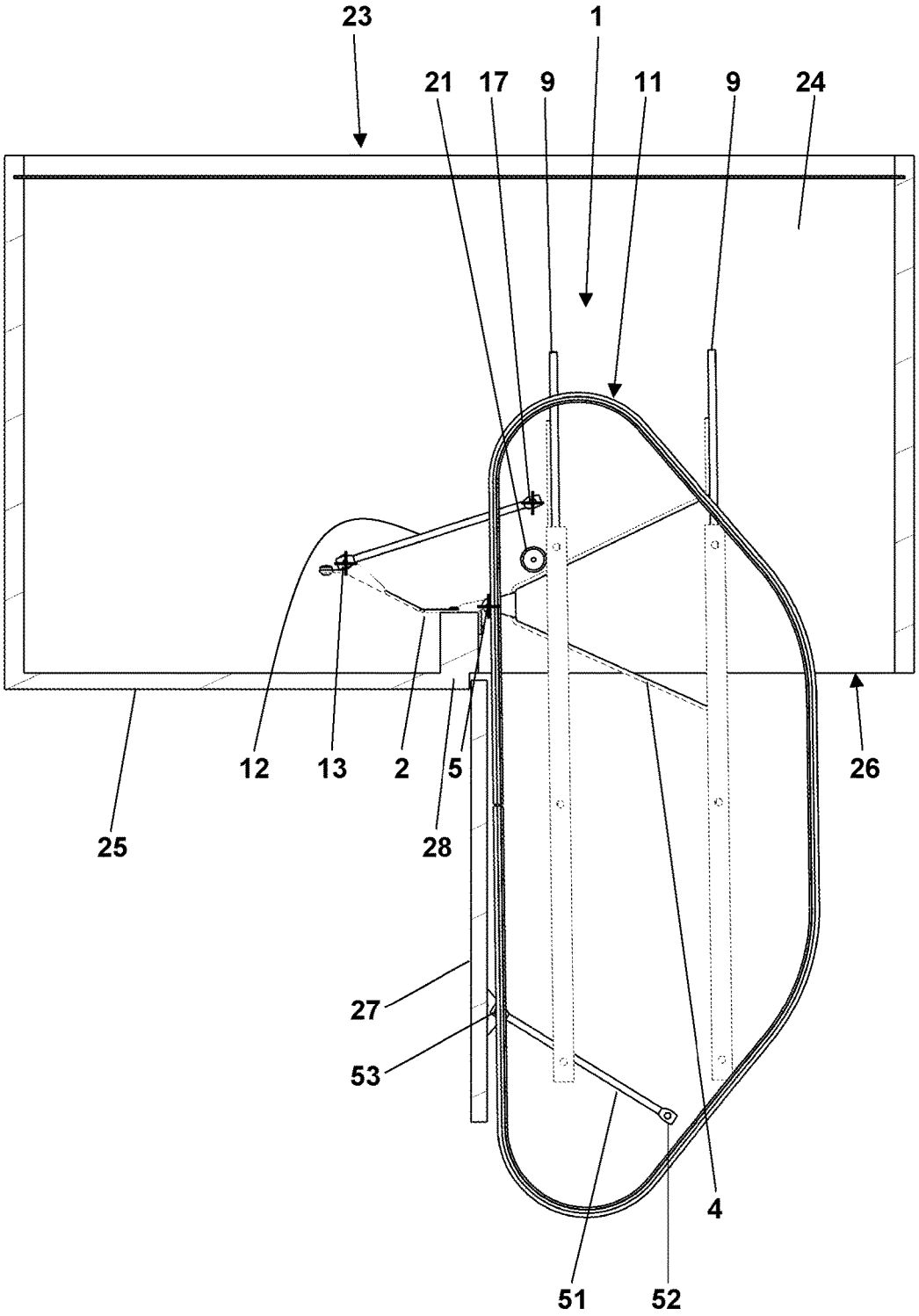

FIG. 2 schematically shows the fitting 1 according to FIG. 1 installed in a corner cupboard 23 comprising a corpus 25 limiting a cuboid interior 24. The corpus 25 leaves a door opening 26 free which can be closed with a cupboard door 27 which can be pivoted open around a vertical door pivot axis running close to a central column 28 of the corner cupboard 23. Through the door opening 26, the tray 11 of which only its surrounding edge is shown here, in order to show also the parts of the fitting 1 lying below it, is to a substantial part movable out of the interior 24 of the corner cupboard 23. This makes the loading and unloading of the tray 11 easier. FIG. 2 (*a*) shows the tray 11 in its maximally inserted position with respect to the support arm 4 and correspondingly in the position of the support arm 4 pivoted maximally inwards with respect to the basis 2. FIG. 2 (*d*), on the contrary, shows the tray 11 extended maximally with respect to the support arm 4 and correspondingly the support arm 4 pivoted maximally outwards with respect to the basis 2. FIGS. 2 (*b*) and (*c*) show intermediate positions and document that the pull-out movement of the tray 11 with respect to the support arm 4 is coupled with the pivot movement of the support arm 4 with respect to the basis 2 by the control arm 12. Furthermore, from the sequence of the FIGS. 2 (*a*) to (*d*) it can be taken how the arrangement of the vertical pivot axes 5, 13 and 17 changes at the movement of the tray 11 out of the corner cupboard 23. In the pushed-in position of the tray 11 according to FIG. 2 (*a*), the first vertical pivot axis lies in the border region of the segment of the interior 24 behind the door opening 26. Against the pull-out direction of the tray 11 along the axis 49, the second vertical pivot axis 13 lies further to the back and the third vertical pivot axis lies even further backwards in the region of the interior 24 next to the door opening 26. The second vertical pivot axis 13 lies at a horizontal distance to the first vertical pivot axis 5 which is slightly smaller than half the horizontal distance between the third vertical pivot axis 17 and the first vertical pivot axis 5. During the pull-out movement of the tray 11, the third vertical pivot axis 17 moves on a curve around the second vertical pivot axis 13 in the direction of the first vertical pivot axis 5. In the pull-out direction along the rail 9, however, the sequence of the vertical pivot axes 5, 13 and 17 remains, i.e. the first vertical pivot axis 5 in the pull-out direction is furthest to the front and the third vertical pivot axis 17 is furthest to the back. By the coupling element 51, the console 53 of which is mounted to the cupboard door 27, where in FIGS. 2 (*a*) to (*c*) the corresponding position of the door 27 is shown by an additional dashed line 27', the movement of the tray 11 out of the interior 24 of the corner cupboard 23 is coupled with the pivoting movement of the cupboard door 27 around its door pivot axis in the vicinity of the central column 28. With the aid of the coupling element, the tray 11 at the opening of the cupboard door 27 is pulled out of the interior 24. The other way around, when the tray 11 is pushed back into the interior 24, the cupboard door 27 is pivoted back in front of the door opening 26. The coupling element 51, in order to achieve this, is at least stiff with respect to tension, preferably, however, realised as a control arm that is also stiff with respect to pressure.

The fitting 1 shown in FIG. 3 in a perspective view from below is different from the one according to FIG. 1 by a basis 2 with a support column 29 comprising a lower fixation plate 30 and an upper fixation device 56 and with a base 31 supported adjustably with respect to height on the support column 29, on which the support arm 4 is supported pivotably around the first vertical pivot axis 5. On the base 31, the control arm 12 is also supported to be pivotable around the second vertical pivot axis 13. The control arm 12 here is realised having three parts and in this way has a variable length between the second vertical pivot axis 13 and the third vertical pivot axis 17. The length of the control arm 12, however, for each pivot position of the control arm 12 around the second vertical pivot axis 13 is defined with respect to the basis 2. A partial arm 32 is supported directly pivotably around the vertical pivot axis 13. With its end turned away from the vertical pivot axis 13, the partial arm 32 engages with an elongated hole 33 in a partial arm 34, so that a further vertical pivot axis between the partial arms 32 and 34 has a variable position along the elongated hole 33. The elongated hole 33 ends before the vertical pivot axis 17 here formed between the partial arm 34 and a counter lever arm 35 of the tray 11. On the counter lever arm 35, the vertical pivot axis 17 here, too, lies in the back area 18 of the tray 11, if outside the bordered storage area of the tray 11. On the end of the partial arm 34 opposite the third vertical pivot axis 17, a partial arm 36 is linked pivotably around a further pivot axis. The partial arm 36 with a guiding roller 37 engages with a horizontal cam track 38. The guiding roller 37 here is arranged on a non-visible guiding pin which protrudes vertically in the central region of the partial arm 36. With its end turned away from the partial arm 34, the partial arm 36 comes into contact with the partial arm 32 between the second vertical pivot axis 13 and the elongated hole 33. The contour of the cam tracks 38 around the second vertical pivot axis 13 controls the length of the control arm 12 in its pivot movement around the second vertical pivot axis 13 with respect to the basis 2. The end of the partial arm 32 turned away from the second vertical pivot axis 13 moves along the elongated hole 33. On both ends of the pivot movement of the control arm 12, stopper buffers 54 or 55 are provided onto which the partial arm 32 impacts. From the basis 2, i.e. an element 41 onto which the base 31 is fixed and in which the cam track 38 is realised, a tension spring 48 engages with the partial arm 34. The tension spring 48 loads the control arm 12 into its position shown in FIG. 3, which corresponds to the pushed-in position of the tray 11 and therefore serves for a self-closing into this position. At the pivoting of the control arm 12 around the second vertical pivot axis 13, the tension spring 48 passes over the second vertical pivot axis 13, in which is reaches is maximum extension. Subsequently, it loads the control arm 12 into its position maximally pivoted around the second vertical pivot axis 13, which corresponds to the maximum extended position of the tray 11. The tension spring 48 in this way brings the tray 11 into both its end positions and keeps it there.

Figure 4:
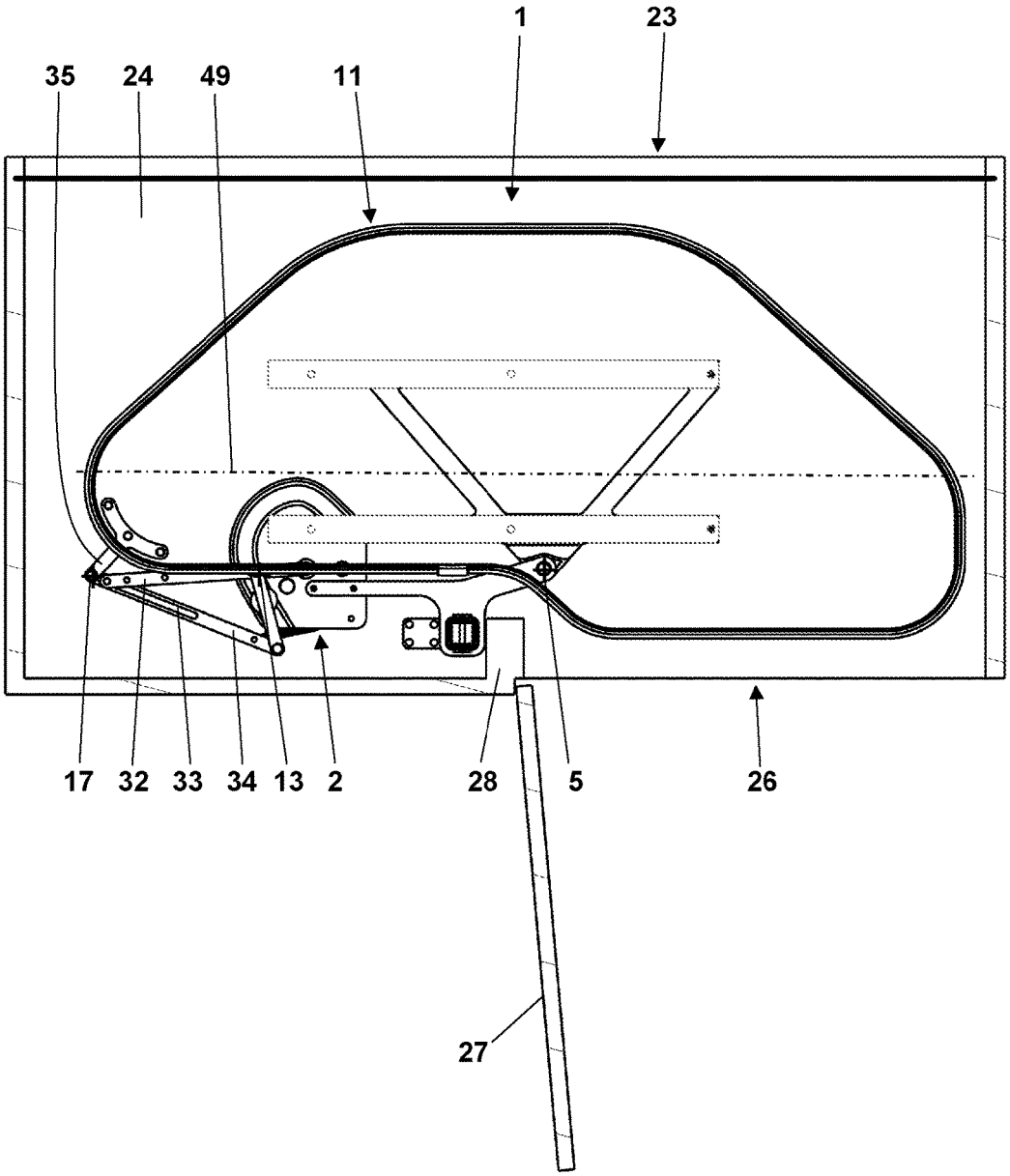
FIG. 4 (*a*) to (*d*) illustrates the movement of a tray of the fitting according to FIG. 3 out of a corner cupboard in which the fitting is mounted.
Figure 4:
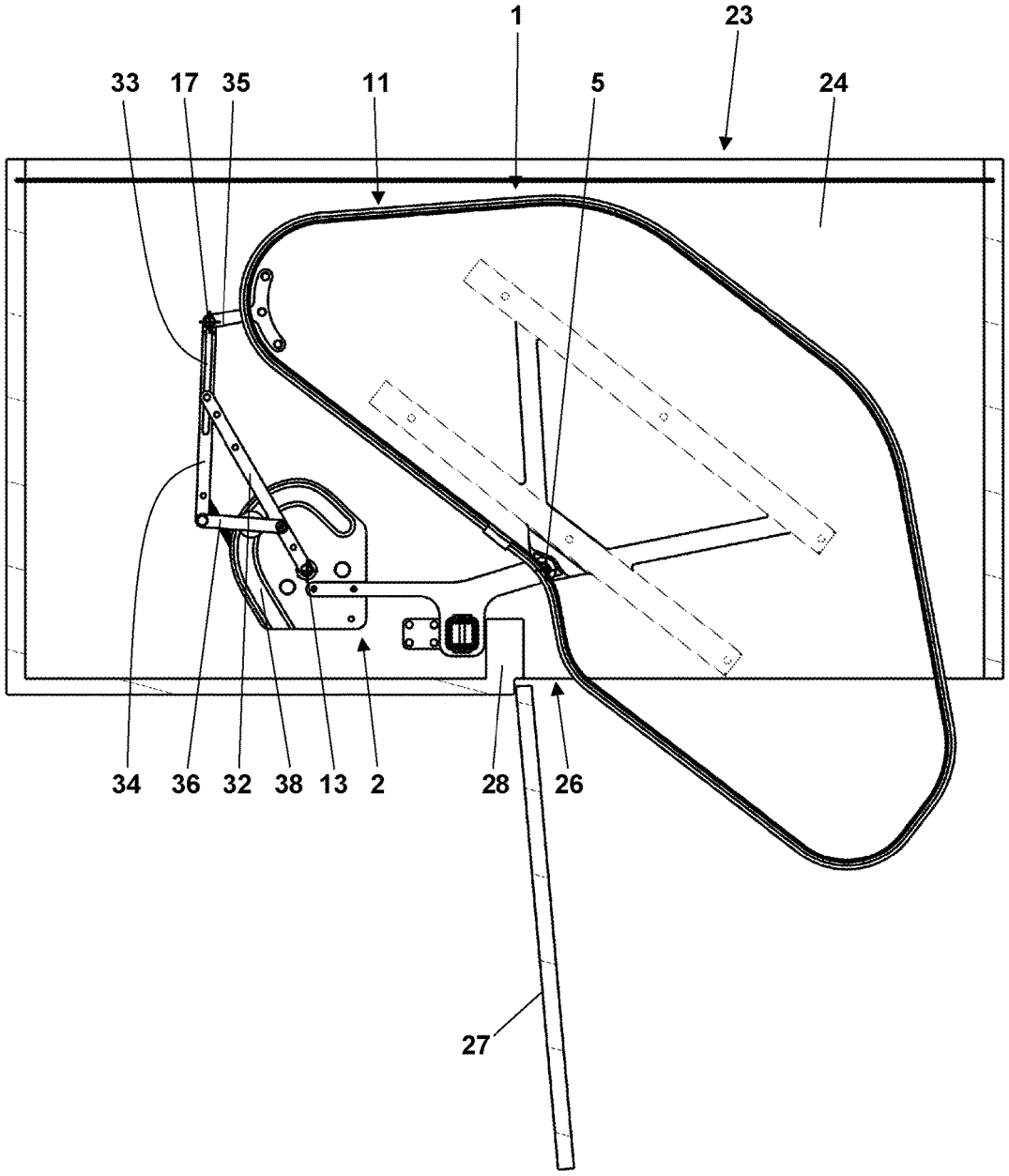
Figure 4:
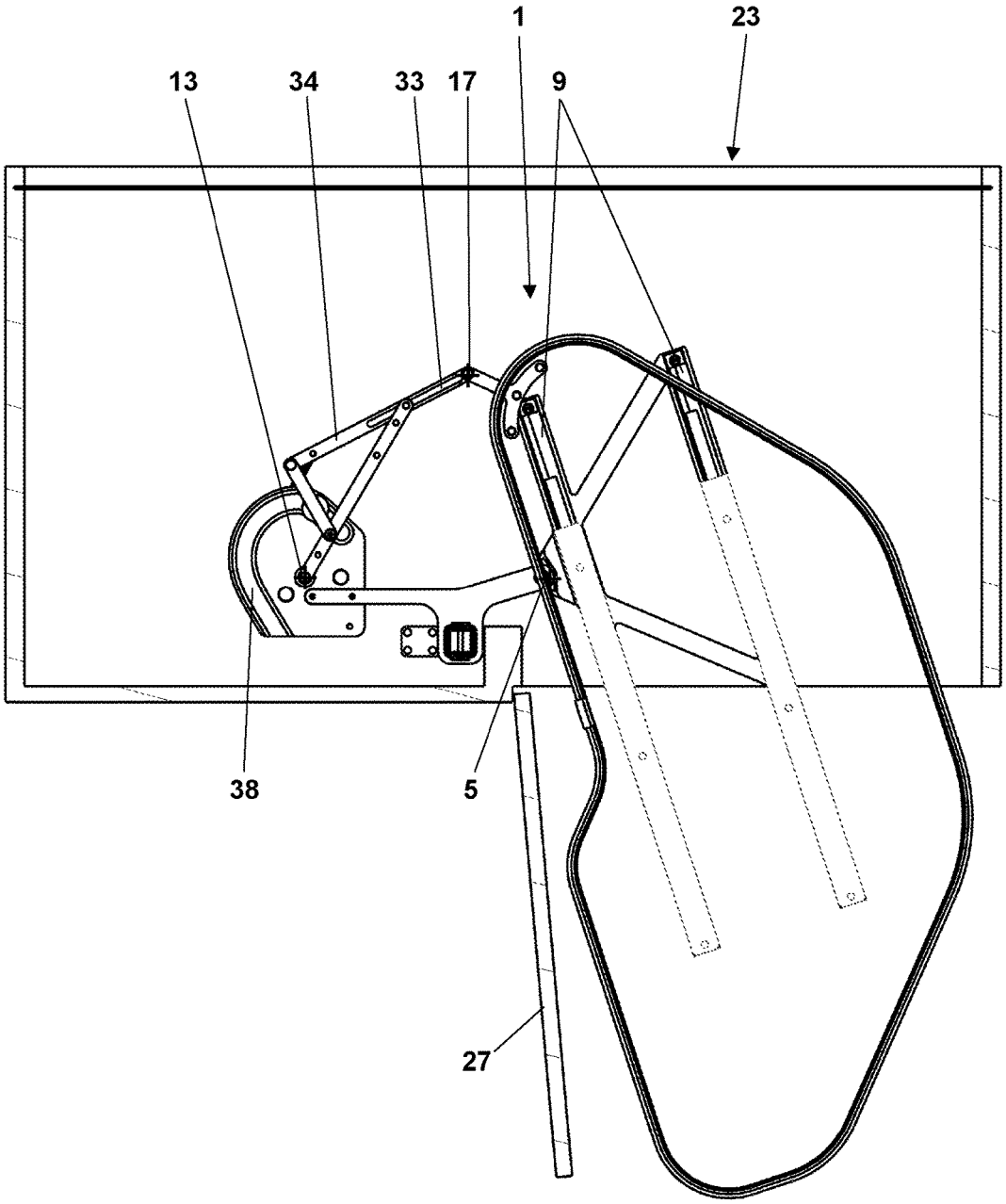
Figure 4:
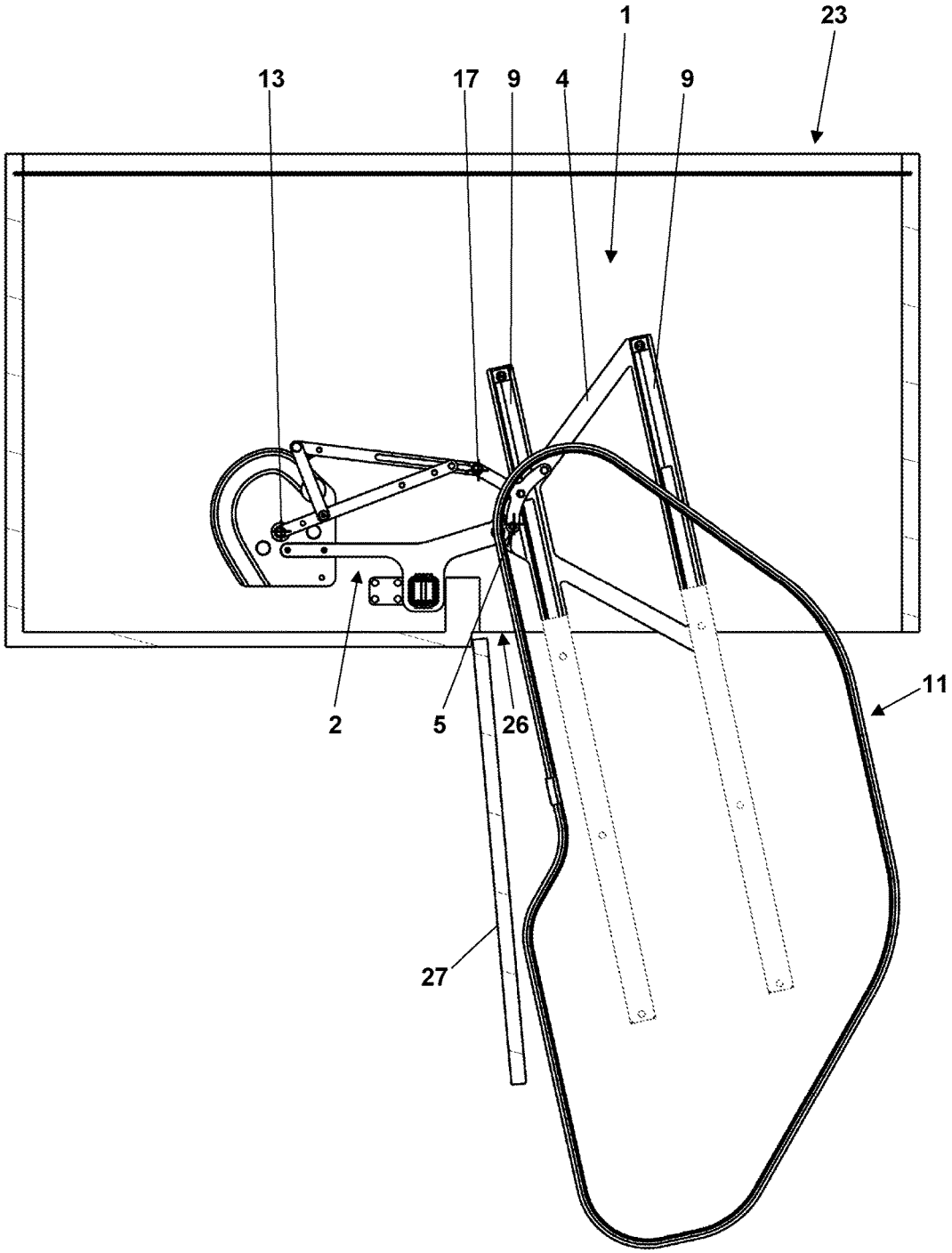

FIG. 4 shows the resulting movement of the tray 11, of which here, too, only its circumferential edge is shown, with respect to the basis 2 and therefore out of the corner cupboard 23. At the end of the movement according to FIG. 4 (*d*), the vertical pivot axes 5, 13 and 17 lie almost together along the axis 49, that is, the pull-out direction of the tray 11 given by the drawer rails 9. Transverse to the axis 49, too, the third vertical pivot axis 17 lies close to the first vertical pivot axis 5. In this way, the tray 11 reaches a pulled-out position lying far in front of the door opening 26. Additionally, the tray 11 comprises a larger area compared to the tray 11 according to FIGS. 1 and 2 with respect to the base area of the corner cupboard 23.

Figure 3:
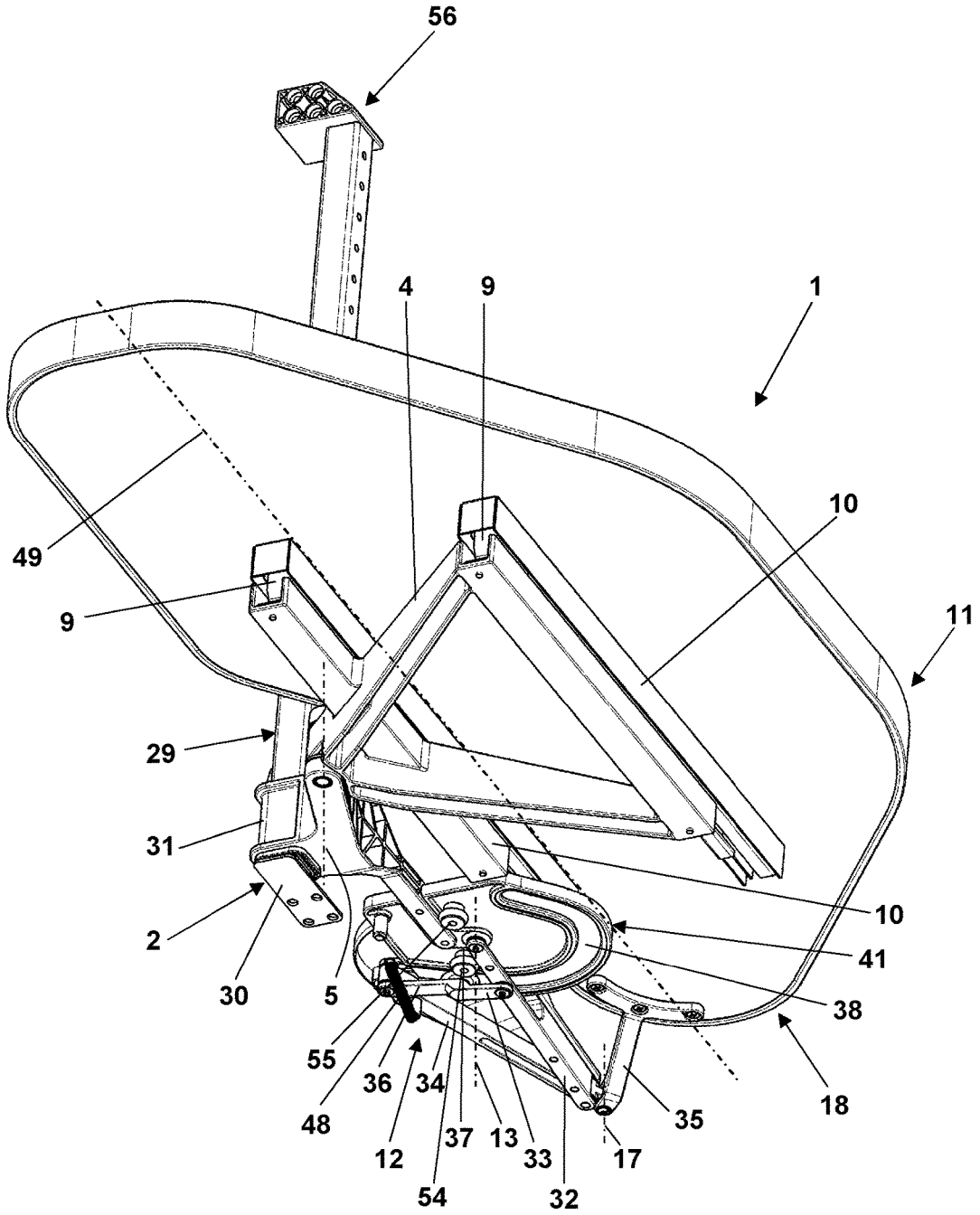
FIG. 3 is a perspective view from below onto a second embodiment of the fitting for a corner cupboard.
Figure 5:
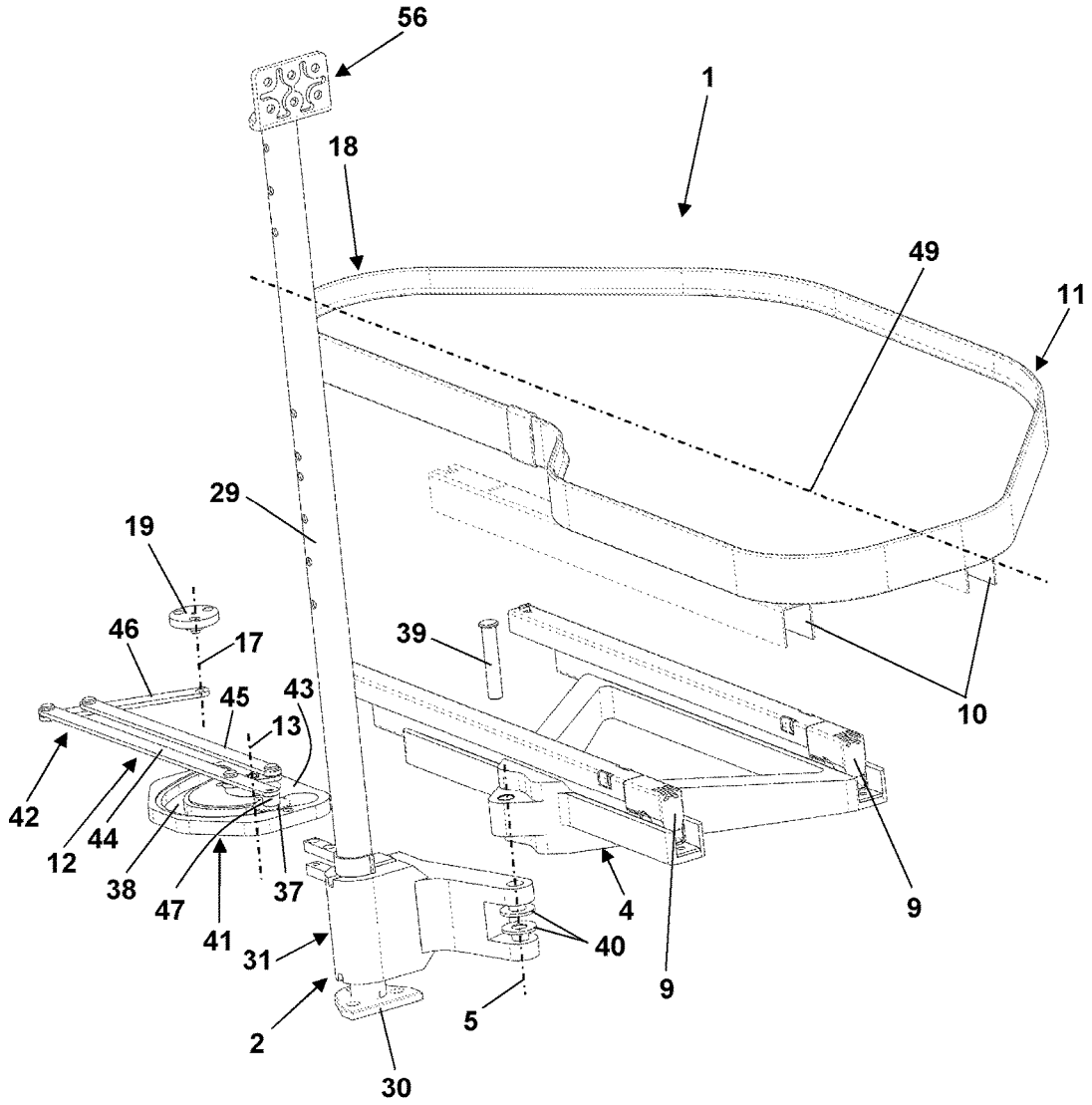
FIG. 5 is an exploded view drawn in perspective of a third embodiment of the fitting for a corner cupboard.
Figure 6:
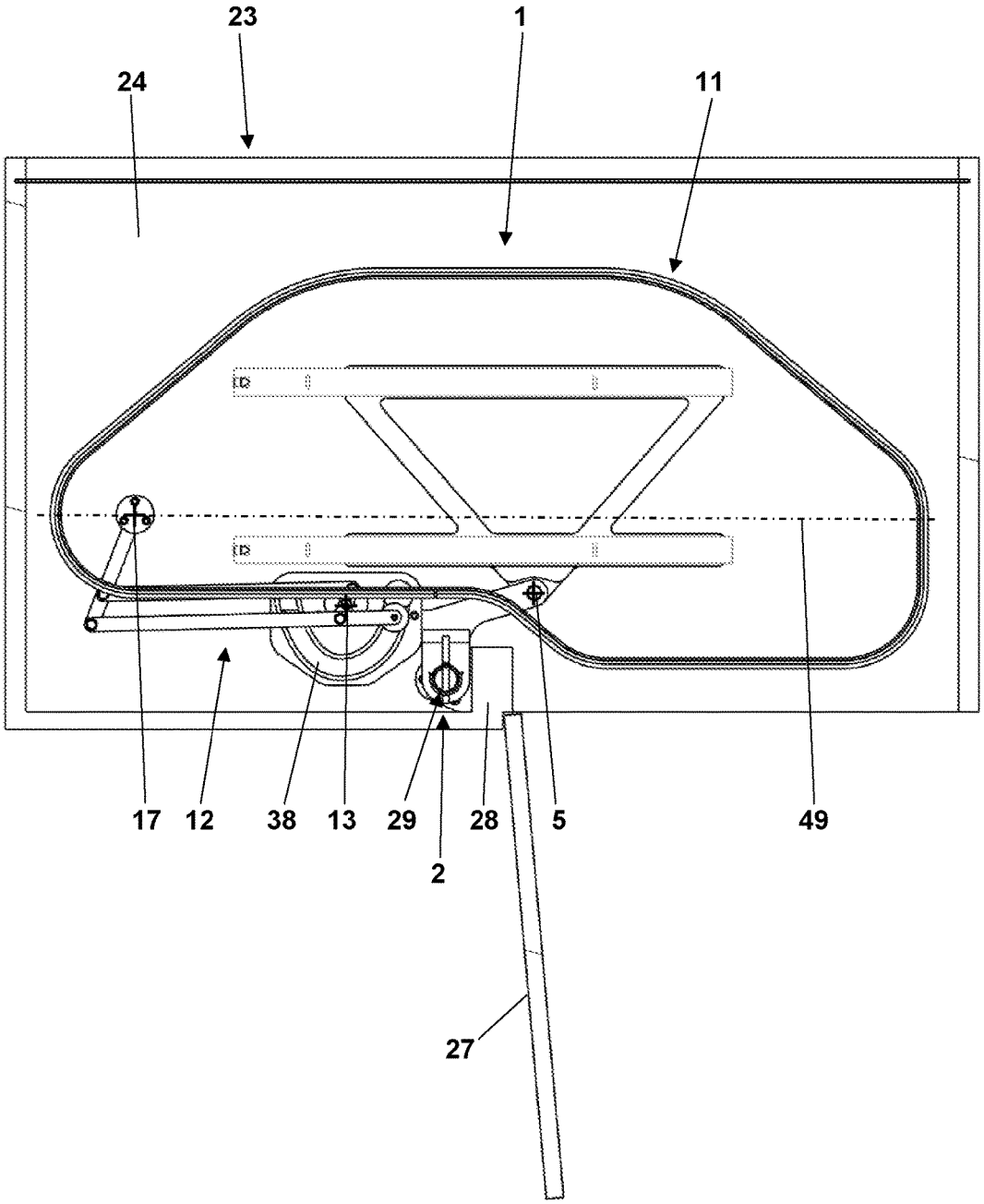
FIG. 6 (*a*) to (*d*) illustrates the movement of a tray of the fitting according to FIG. 5 out of a corner cupboard in which the fitting is mounted.
Figure 6:
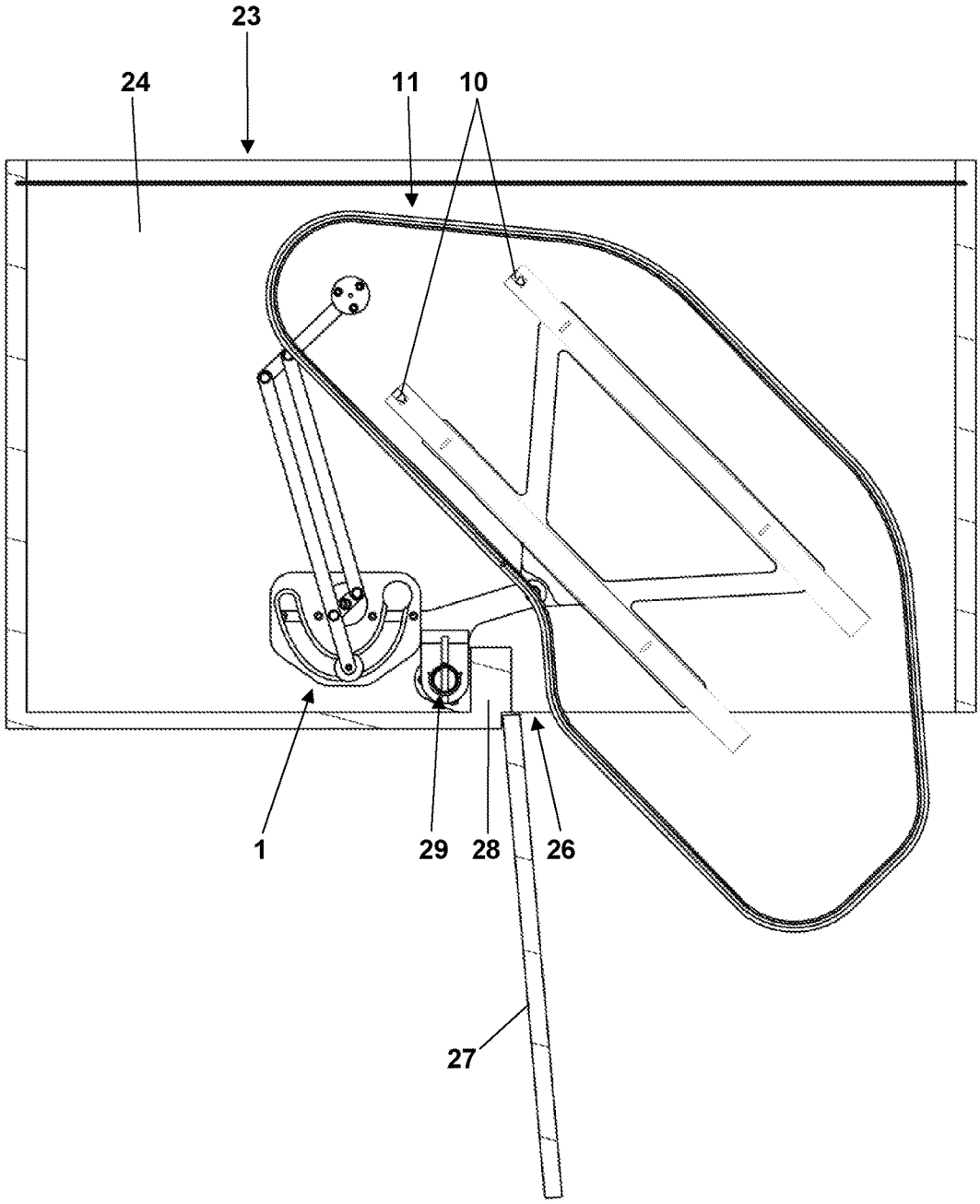
Figure 6:
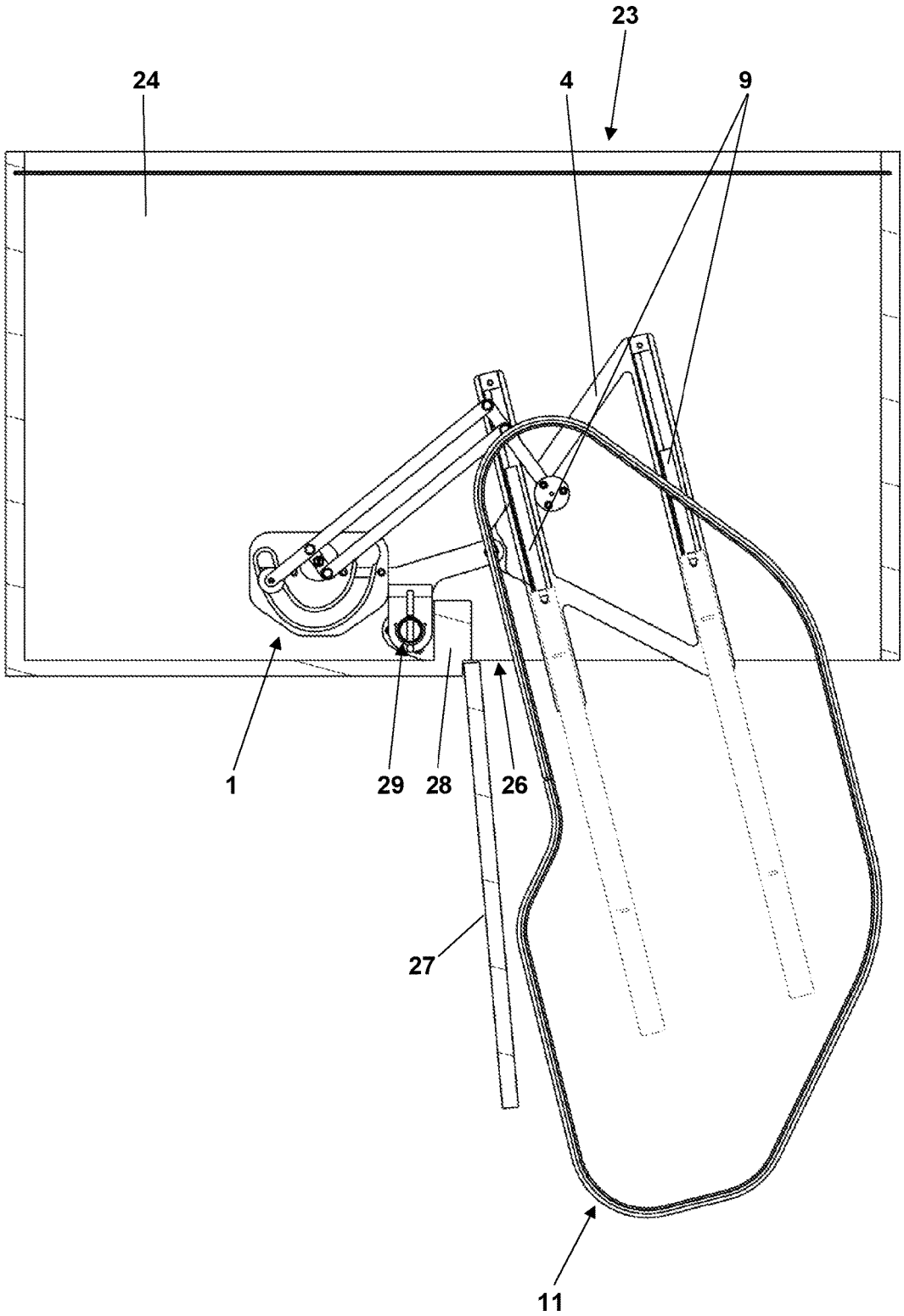
Figure 6:
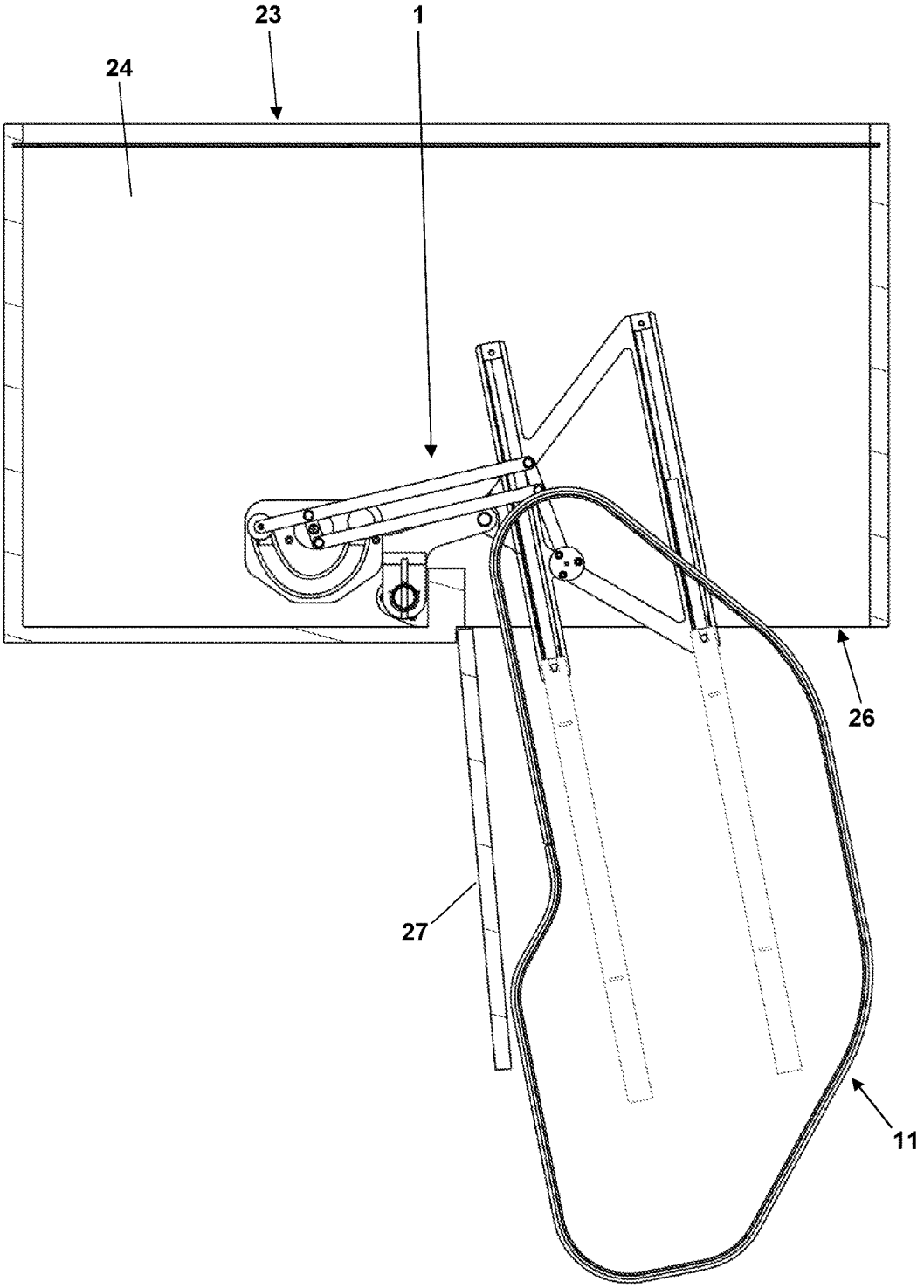

The fitting 1 shown in the perspective explosion drawing according to FIG. 5 is different from the fitting 1 according to FIGS. 3 and 4 by the realisation of the variable-length control arm 12. Additionally, details of the mounting of the support arm 4 onto the base 31 via a bearing pin 39 and intermediate discs 40 can be seen and that the element 41 of the basis 2 on which the cam track 38 is formed has been separately manufactured and fixed to the base 31. The control arm here comprises a parallelogram control lever arrangement 42 with four partial arms 43 to 46. A first short partial arm 43 is supported to be pivotable centrally around the second vertical pivot axis 13. On its two ends, two parallel partial arms 44 and 45 are supported pivotably around further vertical pivot axes. Partial arm 44 does not only jut out over the partial arm 43 in the direction of the forth partial arm 46, but also in the opposite direction, where—with its control bolt 47 and the guiding roller 37 arranged on it—it engages with the cam track 38. The partial arm 46 that is parallel to the partial arm 43 juts out over the vertical pivot axis with respect to the partial arm 45 from the vertical pivot axis with respect to the partial arm 44 until via the support plate 19 it is supported pivotably around the third vertical pivot axis 17 on the underside of the tray 11 in the back area 18. This control arm 12, too, comprises a variable length, that is, however, defined for each pivot position of the control arm 12 around the second vertical pivot axis 13 with respect to the basis 2. With a corresponding adjustment of the contour of the cam track 38, a pull-out path of the tray 11 according to FIG. 6 out of the corner cupboard 23 is realised that is very similar to the pull-out path shown in FIG. 4. The size of the surface of the tray 11, too, of which in FIG. 6, too, only its circumferential edge is shown, compared to the base area of the corner cupboard 23 can be as large as shown in FIG. 4. As in FIG. 4, in FIG. 6, too, it is shown that the basis 2 is supported with the support column 29 next to the central column 28 of the corner cupboard 2, that is, on the side of the central column 28 turned away from the door opening 26.

Many variations and modifications may be made to the preferred embodiments of the invention without departing substantially from the spirit and principles of the invention. All such modifications and variations are intended to be included herein within the scope of the present invention, as defined by the following claims.

I claim:

1. A fitting for a corner cupboard, the fitting comprising a basis having fixation devices configured for fixation of the basis in a stationary way;

a support arm mounted to the basis in such a way that it, with regard to the basis, can be pivoted in a pivoting movement about a first vertical pivot axis out of a swung-in position into a swung-out position;

a tray which is elongated along a horizontal axis and supported on the support arm by means of at least two drawer rails, and which, with regard to the support arm, can be pulled out in a pull-out movement in a direction along the horizontal axis out of a pushed-in position into a pulled-out position, wherein stationary parts of the at least two drawer rails are fixed to the support arm, and wherein movable parts of the drawer rails are fixed to the lower face of the tray, and a coupling device coupling the pivoting movement of the support arm with regard to the basis to the pull-out movement of the tray with regard to the support arm, wherein the coupling device comprises a control arm which, at its one end, is mounted to the basis in such a way that it, with regard to the basis, can be pivoted about a second vertical pivot axis and which, at its other end, is mounted to the tray in such a way that it, with regard to the tray, can be pivoted about a third vertical pivot axis, wherein the third pivot axis, with regard to the pull-out movement, runs in a back area of the tray, and wherein the second pivot axis, in the pushed-in position of the tray, when viewing along the horizontal axis, is arranged between the first pivot axis and the third pivot axis.

2. The fitting of claim 1, wherein a distance between the first pivot axis and the second pivot axis, in the pushed-in position of the tray, when viewing along the horizontal axis, is 30 to 70% of a distance between the first pivot axis and the third pivot axis.

3. The fitting of claim 1, wherein the control arm, in each pivot position about the second pivot axis with regard to the basis, has a positively defined length between the second pivot axis and the third pivot axis.

4. The fitting of claim 1, wherein the control arm comprises a plurality of partial arms which are pivotable with regard to each other about further vertical pivot axes, and wherein the control arm has a length varying over its pivoting positions about the second pivot axis with regard to the basis.

5. The fitting of claim 4, wherein a control pin extending vertically from one of the partial arms of the control arm engages a horizontally running horizontal cam track which is stationary either with regard to the basis or with regard to the tray.

6. The fitting of claim 5, wherein the cam track runs around the second pivot axis in the basis.

7. The fitting of claim 4, wherein the control arm has three partial arms, wherein two of the three partial arms are connected to each other via a horizontal elongated hole in one of the two partial arms in a pivoting way, whereas the other vertical pivot axes between the partial arms are fixed along the partial arms.

8. The fitting of claim 4, wherein the control arm has four partial arms in a four joint arrangement, wherein the four partial arms are optionally provided in a parallelogram control lever arrangement.

9. The fitting of claim 1, wherein a tension spring is attached to the basis and the control arm in such a way that it loads the tray when approaching its pushed-in position into this pushed-in position and when approaching its pulled-out position into this pulled-out position.

10. The fitting of claim 9, wherein the tension spring, in the pushed-in position of the tray, runs on that side of the second pivot axis facing away from the tray, and, in the pulled-out position of the tray, runs on that side of the second pivot axis facing the tray.

11. The fitting of claim 1, wherein the basis includes a vertical support column which comprises the fixation devices at its upper and its lower end.

12. The fitting of claim 11, wherein a base of the basis to which the support arm is mounted in a pivoting way is mounted to the support column in a height adjustable way.

13. The fitting of claim 12, wherein a plurality of bases for a plurality of support arms for a plurality of trays are mounted to the support column one above the other.

14. The fitting of claim 12, wherein the support column, in the pushed-in position of the tray, when viewing along the horizontal axis, is located between the first vertical pivot axis and the second vertical pivot axis.

15. The fitting of claim 12, wherein the support column, in the pushed-in position of the tray, is located on one side of a vertical plane defined by the first pivot axis and the second pivot axis, whereas the drawer rails arranged between the support arm and the tray are located on the other side of this vertical plane.

16. A corner cupboard comprising a corpus, a cuboid-shaped interior defined by the corpus, a door opening only extending over a part of a width of the interior, and a fitting comprising a basis fixed to the corpus in a stationary way by means of fixation devices;

a support arm mounted to the basis in such a way that it, with regard to the basis, can be pivoted in a pivoting movement about a first vertical pivot axis out of a swung-in position into a swung-out position;

a tray which is elongated along a horizontal axis and supported on the support arm by means of at least two drawer rails, and which, with regard to the support arm, can be pulled out in a pull-out movement in a direction along the horizontal axis out of a pushed-in position into a pulled-out position, wherein stationary parts of the at least two drawer rails are fixed to the support arm, and wherein movable parts of the drawer rails are fixed to the lower face of the tray, and a coupling device coupling the pivoting movement of the support arm with regard to the basis to the pull-out movement of the tray with regard to the support arm, wherein the coupling device comprises a control arm which, at its one end, is mounted to the basis in such a way that it, with regard to the basis, can be pivoted about a second vertical pivot axis and which, at its other end, is mounted to the tray in such a way that it, with regard to the tray, can be pivoted about a third vertical pivot axis, wherein the third pivot axis, with regard to the pull-out movement, runs in a back area of the tray, and wherein the second pivot axis, in the pushed-in position of the tray, when viewing along the horizontal axis, is arranged between the first pivot axis and the third pivot axis.

17. The corner cupboard of claim 16, wherein the basis is fixed to the corpus in an area of the interior located beside the door opening.

18. The corner cupboard of claim 16, wherein the first vertical pivot axis runs through an area of the interior of the corner cupboard located behind the door opening.

19. The corner cupboard of claim 16, wherein a coupling element which is at least tensionally stiff is jointed to the tray and to a cupboard door, wherein the cupboard door can be pivoted to open about a vertical door pivot axis running in an area of the front cupboard middle, wherein the tray, when pivoting the cupboard door to open, is moved by the coupling element out of the interior of the corner cupboard, and wherein the cupboard door, when moving the tray into the interior, is pivoted to be closed by the coupling element.

* * * * *